US005460101A

United States Patent [19]

Garbutt, Sr.; Nelson E.

[11] Patent Number: 5,460,101

[45] Date of Patent: Oct. 24, 1995

[54] WALL-MOUNTED FOLDABLE DESK

[76] Inventor: Nelson E. Garbutt, Sr., 4920 11th Ave., Los Angeles, Calif. 90043

[21] Appl. No.: 232,635

[22] Filed: Apr. 25, 1994

[51] Int. Cl.[6] ..... A47B 23/00

[52] U.S. Cl. ..... 108/42; 312/245; 108/40

[58] Field of Search ..... 108/42, 35, 40, 108/41, 33, 34, 38; 312/245, 313

[56] References Cited

U.S. PATENT DOCUMENTS

| | | | |
|---|---|---|---|
| 1,613,830 | 1/1927 | Lindeken | 108/40 X |
| 1,625,354 | 4/1927 | Evans | 188/40 |
| 1,966,800 | 7/1934 | Kateman | 317/313 X |
| 2,963,332 | 12/1960 | Breuning | 312/313 X |
| 3,771,847 | 11/1973 | Aylworth | 312/245 |
| 4,919,498 | 4/1990 | Turner | 312/245 X |
| 5,080,453 | 1/1992 | Miller | 312/245 |

FOREIGN PATENT DOCUMENTS

| | | | |
|---|---|---|---|
| 1168761 | 12/1958 | France | 312/313 |

*Primary Examiner*—Jose V. Chen

[57] ABSTRACT

A wall-mounted foldable desk for providing an elevated working surface comprising two opposed and upwardly extended side plates, each side plate having top and bottom edges with front and rear edges extended therebetween; a bottom plate having front and rear edges with side edges extended therebetween with each side edge coupled to a bottom edge of a side plate; a back plate having top and bottom edges with side edges extended therebetween with the bottom edge coupled to the rear edge of the bottom plate, each side edge coupled to a rear edge of an adjacent side plate, and the top edge aligned with the top edges of each side plate; a first plate having a top surface and a bottom surface, front and rear edges, and opposed side edges extended between the front and rear edges; pivotal structure for pivotally coupling the side edges of the first plate between the side plates to define a pivotable desk top; extendable structure coupled between the desk top and sidewalls and having one position for allowing desk top to be extended upwards in an elevated orientation and another position for allowing the desk top to be extended downwards in a retracted orientation; and coupling structure adapted for coupling the back plate to a wall and thereby allowing the desk top to be placed in the elevated or retracted orientation.

2 Claims, 4 Drawing Sheets

WALL-MOUNTED FOLDABLE DESK

BACKGROUND OF THE INVENTION

1. Field of the Invention

The present invention relates to a wall-mounted foldable desk and more particularly pertains to providing an elevated working surface for use in areas of limited space with a wall-mounted foldable desk.

2. Description of the Prior Art

The use of furniture is known in the prior art. More specifically, furniture heretofore devised and utilized for the purpose of providing an elevated working surface are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 295,007 to Hardy et al. discloses a wall-mounted foldable work bench. U.S. Pat. No. Des. 326,384 to Burt et al. discloses a fold down, wall-mounted diaper changing table. U.S. Pat. No. Des. 330,986 to Lau discloses a wall mounted folding table. U.S. Pat. No. 4,280,744 to Nakano discloses a foldable desk. U.S. Pat. No. 5,085,608 to Turner discloses a collapsible desk with dollhouse.

While these devices fulfill their respective, particular objective and requirements, the aforementioned patents do not describe a wall-mounted foldable desk that is ergonomically designed to provide a user a durable working surface when placed in an extended and operable configuration and yet utilize a minimum amount of space when placed in a retracted and stowed configuration.

In this respect, the wall-mounted foldable desk according to the present invention substantially departs from the conventional concepts and designs of the prior art, and in doing so provides an apparatus primarily developed for the purpose of providing an elevated working surface for use in areas of limited space.

Therefore, it can be appreciated that there exists a continuing need for new and improved wall-mounted foldable desk which can be used for providing an elevated working surface for use in areas of limited space. In this regard, the present invention substantially fulfills this need.

SUMMARY OF THE INVENTION

In the view of the foregoing disadvantages inherent in the known types of furniture now present in the prior art, the present invention provides an improved wall-mounted foldable desk. As such, the general purpose of the present invention, which will be described subsequently in greater detail, is to provide a new and improved wall-mounted foldable desk and method which has all the advantages of the prior art and none of the disadvantages.

To attain this, the present invention essentially comprises, in combination, two opposed, spaced, upwardly extended, and rectangular side plates, each side plate having opposed top and bottom edges with opposed front and rear edges extended therebetween. A rectangular bottom plate is included and has opposed front and rear edges with opposed side edges extended therebetween with each side edge coupled to a bottom edge of a side plate and the front edge thereof having a notch centrally disposed thereon. A rectangular back plate is included and has opposed top and bottom edges with opposed side edges extended therebetween with the bottom edge coupled to the rear edge of the bottom plate. Each side edge is coupled to a rear edge of an adjacent side plate, and the top edge is planarly aligned with the top edges of each side plate. A container is included. The container includes a rectangular bottom plate extended across and coupled to the top edge of the back plate and top edges of the side plates. The container includes a peripheral, planar, and upwardly extended border integrally coupled around the bottom plate to define a rectangular and opened top. The container also includes a planar, rectangular, and perforated top plate coupled across the border to cover a portion of the opened top with the perforations adapted for holding elongated items placed therein and projected downwards into the container. A planar and rectangular first plate is included and has opposed front and rear edges with opposed side edges extended therebetween. The rear edge is coupled to the back plate and each side edge coupled to an adjacent side plate at a distance offset from the top edges thereof to define a shelf. A planar and rectangular second plate is included and has a top surface and a bottom surface, front and rear edges, and opposed side edges extended between the front and rear edges. A first hinge couples the rear edge of the second plate to the front edge of the first plate to define a pivotable desk top. Planar and rectangular first and second support plates are included. Each support plate has opposed top and bottom edges with opposed side edges extended therebetween. The first support plate is coupled to the back plate between the first plate and bottom plate. The second support plate is coupled to the back plate between the first plate and first support plate. A planar and rectangular bracing leg is included and has opposed upper and lower edges with opposed side edges extended therebetween. A second hinge pivotally couples the upper edge of the bracing leg with the bottom surface of the second plate at a distance offset from the front edge thereof. The second hinge has one position for allowing the bracing leg to be diagonally extended between the first support plate and second plate such that the desk top is planarly aligned with the shelf in an elevated orientation and another position for allowing the bracing leg to be extended downwards through the notch of the bottom plate such that the desk top is placed in a retracted orientation between the two side plates. Lastly, coupling means are included and adapted for coupling the back plate to a wall and thereby allowing the desk top to be placed in the elevated or retracted orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wall-mounted foldable desk which has all the advantages of the prior art furniture and none of the disadvantages.

It is another object of the present invention to provide a new and improved wall-mounted foldable desk which may be easily and efficiently manufactured and marketed.

It is a further object of the present invention to provide a new and improved wall-mounted foldable desk which is of durable and reliable construction.

An even further object of the present invention is to provide a new and improved wall-mounted foldable desk which is susceptible of a low cost of manufacture with regard to both materials and labor, and which accordingly is then susceptible of low prices of sale to the consuming public, thereby making such a wall-mounted foldable desk economically available to the buying public.

Still yet another object of the present invention is to provide a new and improved wall-mounted foldable desk which provides in the apparatuses and methods of the prior art some of the advantages thereof, while simultaneously overcoming some of the disadvantages normally associated therewith.

Even still another object of the present invention is to provide a new and improved wall-mounted foldable desk for providing an elevated working surface for use in areas of limited space.

Lastly, it is an object of the present invention to provide a new and improved wall-mounted foldable desk comprising two opposed, spaced, and upwardly extended side plates, each side plate having top and bottom edges with front and rear edges extended therebetween; a bottom plate having front and rear edges with side edges extended therebetween with each side edge coupled to a bottom edge of a side plate and the front edge thereof having a notch centrally disposed thereon; a back plate having top and bottom edges with side edges extended therebetween and with the bottom edge thereof coupled to the rear edge of the bottom plate, each side edge coupled to a rear edge of an adjacent side plate, and the top edge planarly aligned with the top edges of each side plate; a first plate having a top surface and a bottom surface, front and rear edges, and opposed side edges extended between the front and rear edges; pivotal means for pivotally coupling the side edges of the first plate between the side plates to define a pivotable desk top; extendable means coupled between the desk top and sidewalls and having one position for allowing desk top to be extended upwards and away from the side plates in an elevated orientation and another position for allowing the desk top to be extended downwards and between the side plates in a retracted orientation; and coupling means adapted for coupling the back plate to a wall and thereby allowing the desk top to be placed in the elevated or retracted orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
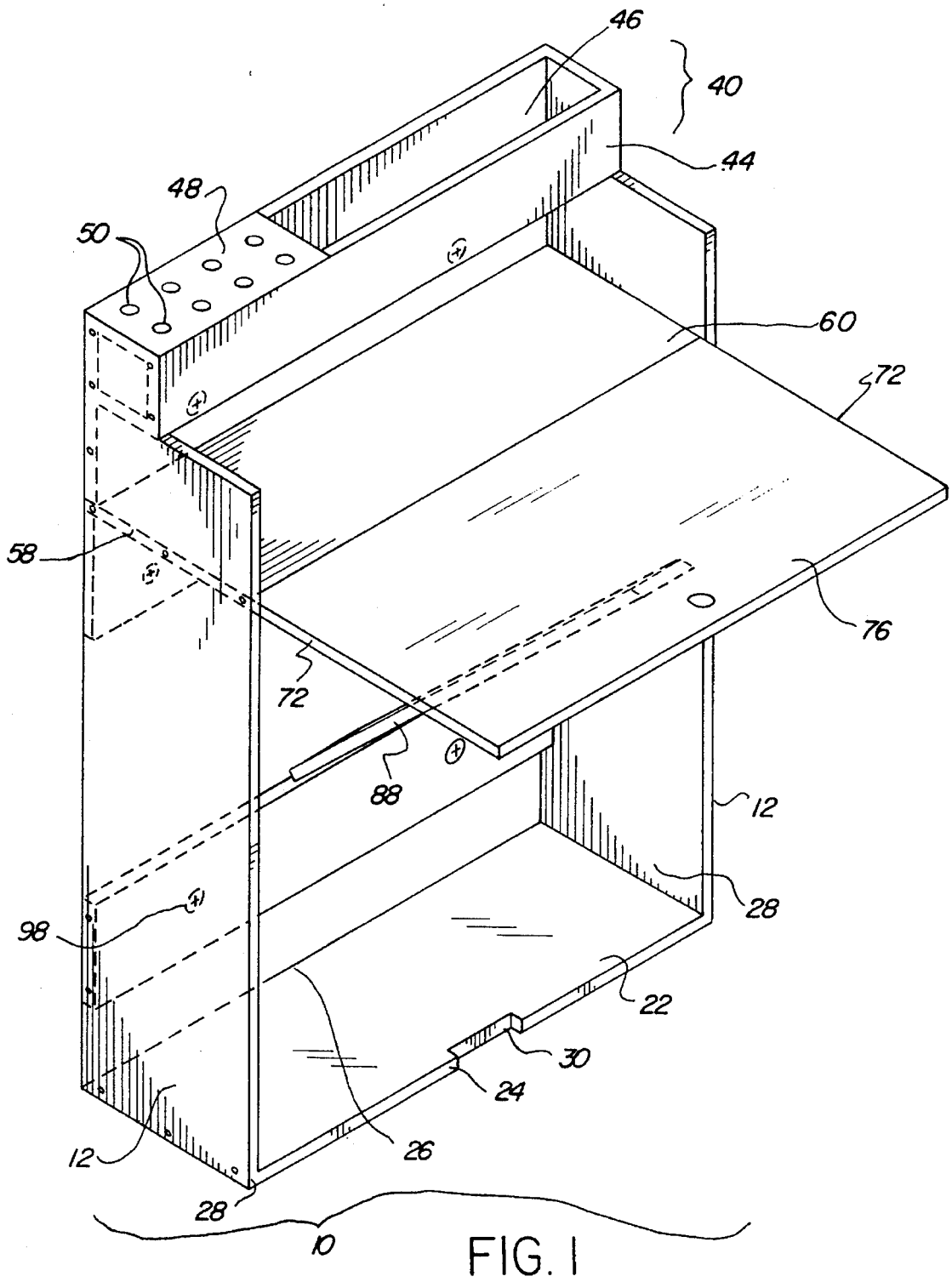
FIG. 1 is a perspective view of the preferred embodiment of the wall-mounted foldable desk constructed in accordance with the principles of the present invention.
Figure 2:
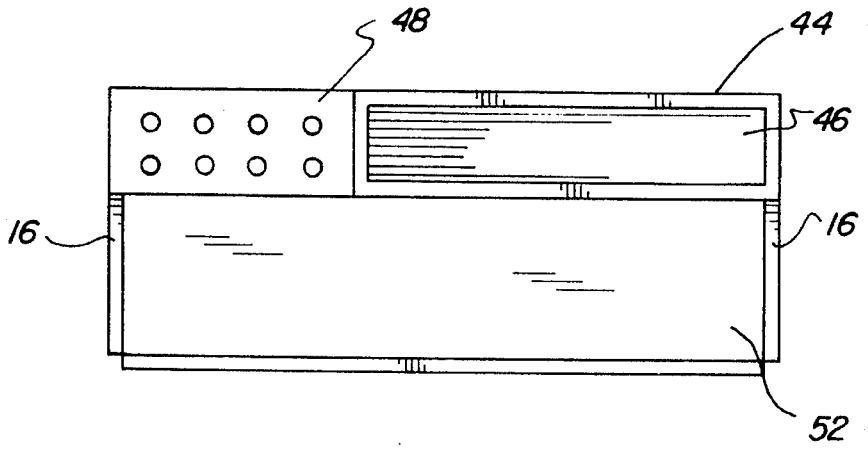
FIG. 2 a top view of the present invention with the desk top in a stowed orientation.
Figure 3:
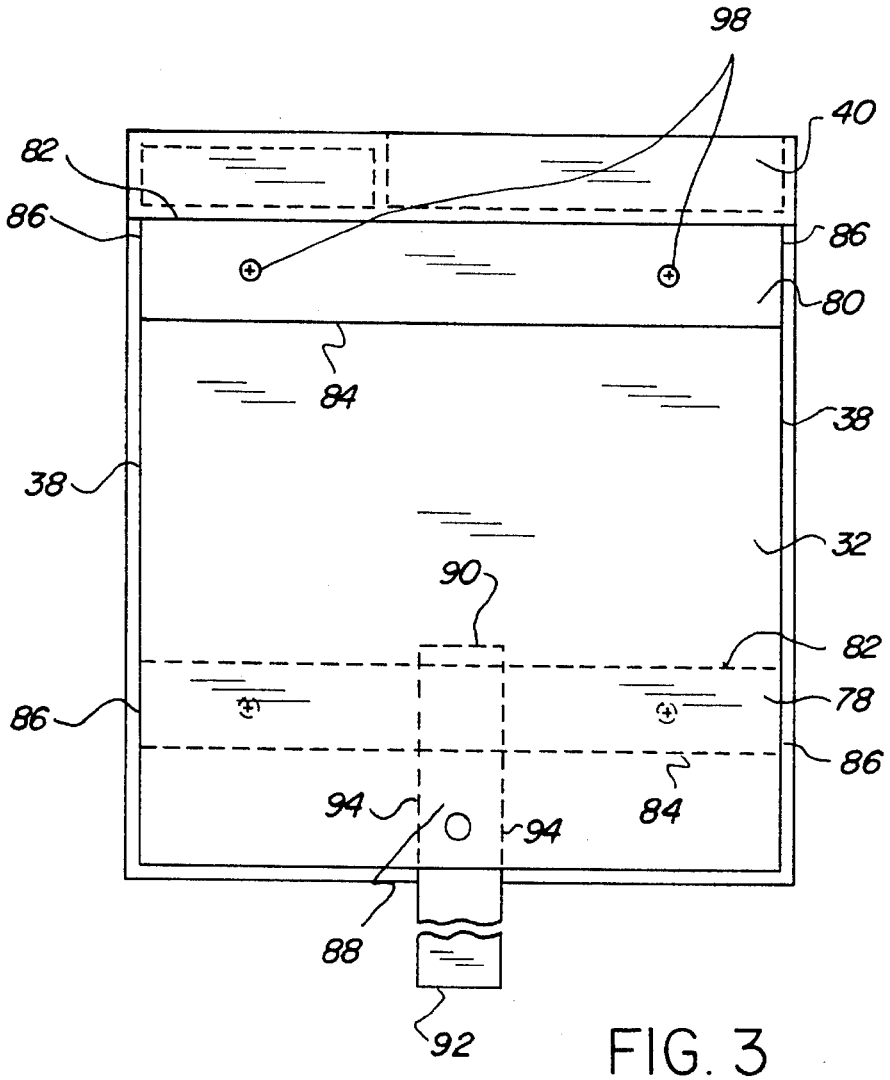
FIG. 3 is a front elevational view of the present invention depicting the desk top placed in a retracted and stowed orientation.
Figure 4:
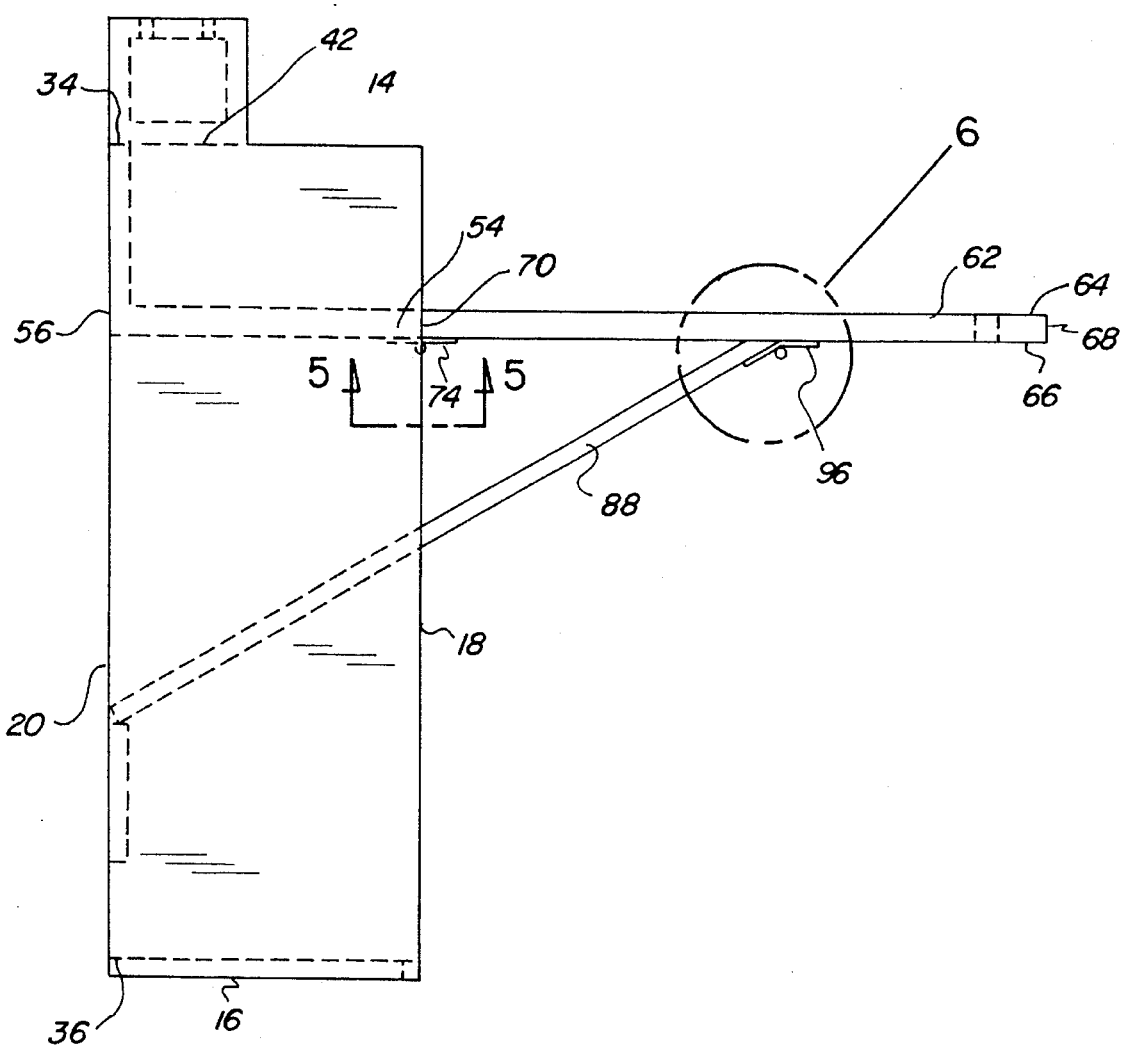
FIG. 4 a side elevational view of the present invention with the desk top placed in an extended and operable orientation.
Figure 5:
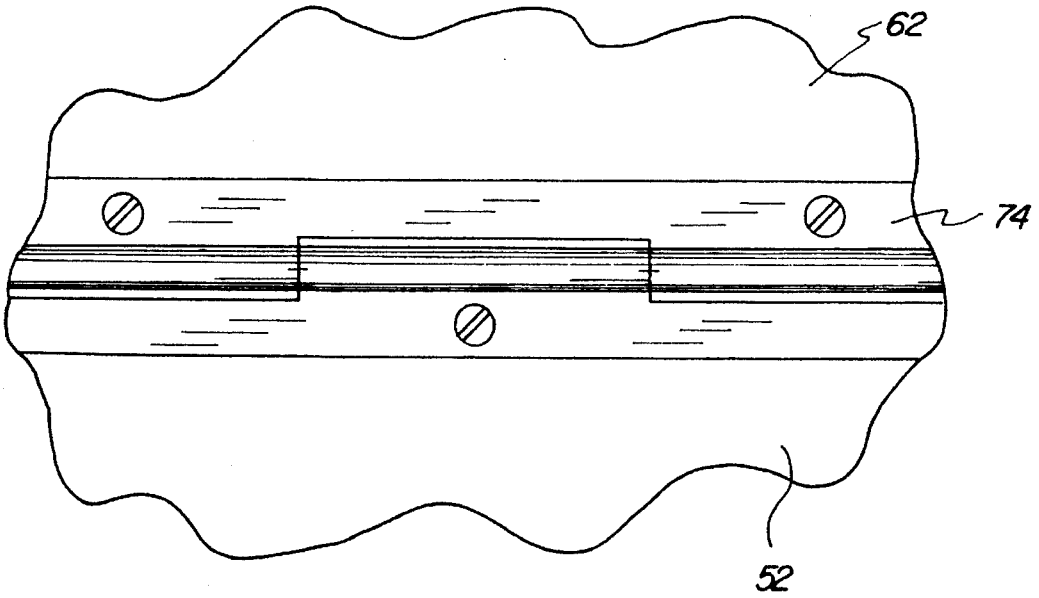
FIG. 5 is a close-up view of the first hinge taken along the line 5—5 of FIG. 4.
Figure 6:
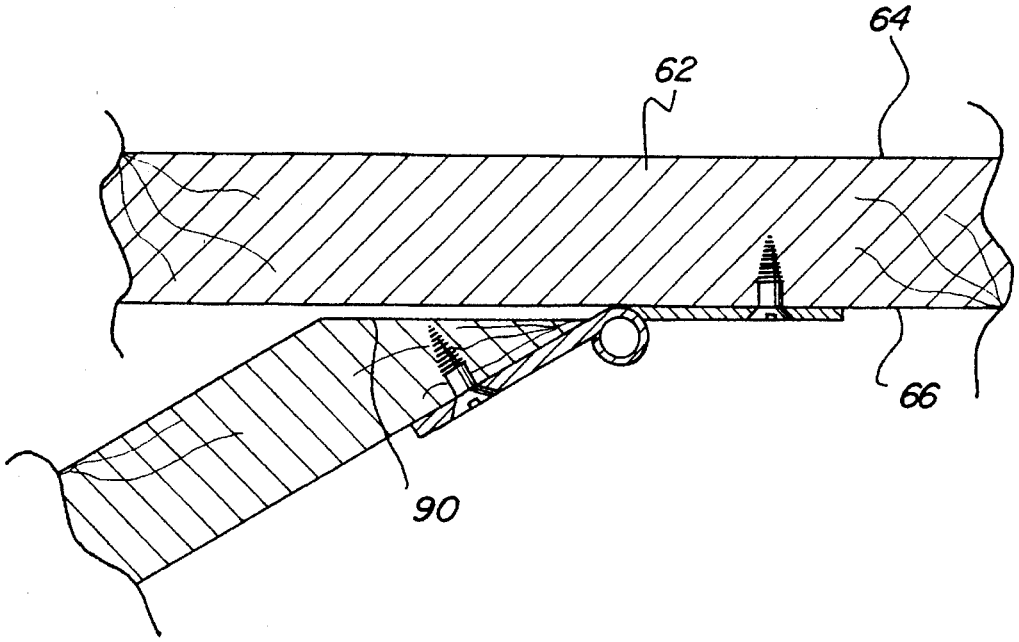
FIG. 6 is an enlarged side elevational view of the second hinge coupling between the second plate and bracing leg.

With reference now to the drawings, and in particular, to FIG. 1 thereof, the preferred embodiment of the new and improved wall-mounted foldable desk embodying the principles and concepts of the present invention and generally designated by the reference number 10 will be described.

Specifically, the present invention includes 11 major components. The major components are the side plates, bottom plate, back plate, container, first plate, second plate, first hinge, support plates, bracing leg, second hinge and coupling means. These components are interrelated to provide the intended function.

More specifically, it will be noted in the various Figures that the first major component is the side plates 12. Two side plates are included in the present invention. The side plates are rigid in structure and spaced a distance from each other. They are upwardly extended and parallely aligned. Each side plate has opposed top and bottom edges 14, 16. Each side plate also has opposed front and rear edges 18, 20 extended between the top and bottom edges.

The second major component is the bottom plate 22. The bottom plate is rectangular and rigid in structure. The bottom plate has opposed front and rear edges 24, 26. The bottom plate also has opposed side edges 28 extended between the front and rear edges. Each side edge of the bottom plate is coupled to a bottom edge 14 of a side plate. The front edge 24 of the bottom plate has a notch 30 centrally disposed thereon. This notch will be used as a guiding channel.

The third major component is the back plate 32. The back plate is rigid and rectangular in structure. The back plate has opposed top and bottom edges 34, 36. The back plate also has opposed side edges 38 extended between the top and bottom edges. The bottom edge of the back plate is coupled to the rear edge 26 of the bottom plate. Each side edge of the back plate is coupled to a rear edge 20 of an adjacent side plate. The back plate is extended upwards such that the top edge is planarly aligned with the top edges 14 of each side plate. The side plates in combination with the bottom plate and back plate essentially form a rigid cabinet used for holding the other components of the invention. In this configuration, the bottom plate may be used as a shelf.

The fourth major component is the container 40. The container includes 3 subcomponents. The subcomponents are the bottom plate, the border, and the top plate. These subcomponents are interrelated to provide the intended function.

The first subcomponent of the container is the bottom plate 42. The bottom plate is rigid and rectangular in structure. The bottom plate is extended across and coupled to the top edge 34 of the back plate and the top edges 14 of the side plates. The bottom plate serves as the bottom portion of the container.

The second subcomponent of the container is the border 44. The border is rigid in structure. It is upwardly extended around the periphery of the bottom plate 42 and is terminated therefrom to define a rectangular and opened top 46. The border defines the side portion of the container.

The third subcomponent of the container is the top plate 48. The top plate is planar and rectangular in structure. It has a plurality of perforations 50 disposed thereon. The top plate is coupled across the border 44 to cover a portion of the opened top 46. The perforations are adapted for holding elongated items placed therein and projected downwards into the container. This configuration allows writing utensils such as pencils and pens to be held in an orientation for easy access. The opened portion of the container provides a convenient place for holding writing supplies such as notebooks or papers.

The fifth major component is the first plate 52. The plate is planar, rigid, and rectangular in structure. The first plate has opposed front and rear edges 54, 56. The first plate also has opposed side edges 58 extended between the front and rear edges. The rear edge 56 of the first plate is coupled to the back plate 32. Each side edge of the first plate is coupled to an adjacent side plate 12 at a distance offset from the top edges 14 of each side plate. This configuration defines a shelf 60 adapted for holding work related items such as books or papers. The shelf is also conveniently located near the container for allowing a user to access both simultaneously.

The sixth major component is the second plate 62. The second plate is planar, rigid, and rectangular in structure. The second plate has a top surface 64 and a bottom surface 66. The second plate also has front and rear edges 68, 70. The second plate also has opposed side edges 72 extended between the front and rear edges. The lateral extension of the first plate and the second plate between the side plates is approximately equal; however, the outward extension of the second plate is greater than that of the first plate in order to create an extended working surface for performing work and supporting work-related items thereon.

The seventh major component is the first hinge 74. The first hinge couples the rear edge 70 of the second plate to the front edge 54 of the first plate. The pivotal second plate thereby defines a desk top 76.

The eighth major component is the support plates. The present invention includes a first support plate 78 and a second support plate 80. Both support plates are planar, rigid, and rectangular in structure. Each support plate has top and bottom edges 82, 84. Each support plate also has opposed side edges 86 extended between the top and bottom edges. The first support plate is coupled to the back plate 32 between the first plate 52 and the bottom plate 22. The second support plate is laterally coupled to the back plate between the first plate 52 and the first support plate. The support plates are also extended to locations adjacent to the side plates. In this configuration, the support plates add rigidity to the frame defined by the side plates, bottom plate, and back plate.

The ninth major component is the bracing leg 88. The bracing leg has opposed upper and lower edges 90, 92. The bracing leg also has opposed side edges 94 extended between the upper and lower edges. The bracing leg has a length such that it is adapted to be diagonally extended between the first support plate and desk top such that the desk top is held in an essentially level orientation.

The tenth major component is a second hinge 96. The second hinge pivotally couples the upper edge 90 of the bracing leg with the bottom surface 66 of the second plate at a distance offset from the front edge 68 thereof. The hinge has one position for allowing the bracing leg to be diagonally extended between the first support plate 78 and the second plate 62. In this configuration, the desk top 76 is planarly aligned with the shelf 60 in an elevated orientation. This elevated orientation provides an extended working surface for a user. The hinge also has another position for allowing the bracing leg to be extended downwards through the notch 30 of the bottom plate such that the desk top is placed in a retracted and downwardly extended orientation between the two side plates 12. The retracted orientation thereby allows the present invention to be positioned in an area with limited space such as a hallway, thereby allowing an extended working surface to be available in areas that could not otherwise support one.

The eleventh major component is the coupling means 98. The coupling means is used for coupling the back plate 32 to a wall or other upwardly extended support structure at a position offset from the ground or floor such that the desk top can be placed in the extended or the retracted orientation.

The present invention has been designed for use in homes or other areas which do not have sufficient room for a desk. This problem commonly occurs when a child wishes to have a desk of their own. Few bedrooms will accept a desk, and many parents are reluctant to place a desk in the living or dining room. In addition, children prefer a more private area, but unless the home has a den or other room, the family is faced with a dilemma when they consider where they can add a desk. This invention offers a valid option for providing a very useful desk that does not invade the living space in a home.

The present invention is a self-contained wall unit which contains a swing-up desk top that provides the basic convenience of a desk. It is large enough for the student to write upon, with reference material at hand. The desk top swings out from a narrow cabinet which is attached to the wall. A diagonal bracing leg swings out to support the desk top at its outer edge, providing the necessary stability. The top of the cabinet has compartments for such items as pens, pencils, erasers, paper clips, paper and paper pads.

This innovative desk could be made of wood, selected to match that of the furnishings, or from plastic or metal. The desk top can have a suitable cover which will not be marred by pencil or pen impressions and will withstand even powerful chemicals.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wall-mounted foldable desk for providing an elevated working surface for use in areas with limited space comprising, in combination:

two opposed, spaced, upwardly extended, and rectangular side plates, each side plate having opposed top and bottom edges with opposed side front and rear edges extended therebetween;

a rectangular bottom plate having opposed front and rear edges with opposed side edges extended therebetween with each side edge coupled to a bottom edge of a side plate and the front edge thereof having a notch centrally disposed thereon;

a rectangular back plate having opposed top and bottom edges with opposed side edges extended therebetween and with the bottom edge thereof coupled to the rear edge of the bottom plate, each side edge coupled to a rear edge of an adjacent side plate, and the top edge planarly aligned with the top edges of each side plate;

a container further comprising:

a rectangular bottom plate extended across and coupled to the top edge of the back plate and top edges of the side plates;

a peripheral, planar, and upwardly extended border integrally coupled around the bottom plate of the container to define a rectangular and opened top; and a planar, rectangular, and perforated top plate coupled across the border to cover a portion of the opened top with the perforations adapted for holding elongated items placed therein and projected downwards into the container;

a planar and rectangular first plate having opposed front and rear edges with opposed side edges extended therebetween, the rear edge coupled to the back plate and each side edge coupled to an adjacent side plate at a distance offset from the top edges thereof to define a shelf;

a planar and rectangular second plate having a top surface and a bottom surface, front and rear edges, and opposed side edges extended between the front and rear edges;

a first hinge coupling the rear edge of the second plate to the front edge of the first plate to define a pivotable desk top;

a planar and rectangular first support plate and a planar and rectangular second support plate, each support plate having an opposed top and bottom edges with opposed side edges extended therebetween with the first support plate coupled to the back plate between the first plate and bottom plate and the second support plate coupled to the back plate between the first plate and first support plate;

a planar and rectangular bracing leg having opposed upper and lower edges with opposed side edges extended therebetween; and a second hinge pivotally coupling the upper edge of the bracing leg with the bottom surface of the second plate at a distance offset from the front edge thereof, the second hinge having one position for allowing the bracing leg to be diagonally extended between the first support plate and second plate such that the desk top is planarly aligned with the shelf in an elevated orientation and another position for allowing the bracing leg to be extended downwards through the notch of the bottom plate such that the desk top is placed in a retracted orientation between the two side plates; and coupling means adapted for coupling the back plate to a wall and thereby allowing the desk top to be placed in the elevated or retracted orientation.

2. A wall-mounted foldable desk for providing an elevated working surface for use in areas with limited space comprising:

two opposed, spaced, and upwardly extended side plates, each side plate having top and bottom edges with front and rear edges extended therebetween;

a bottom plate having front and rear edges with side edges extended therebetween with each side edge coupled to a bottom edge of a side plate and the front edge thereof having a notch centrally disposed thereon;

a back plate having top and bottom edges with side edges extended therebetween and with the bottom edge thereof coupled to the rear edge of the bottom plate, each side edges coupled to a rear edge of an adjacent side plate, and the top edge planarly aligned with the top edges of each side plate;

a first plate having a top surface and a bottom surface, front and rear edges, and opposed side edges extended between the front and rear edges;

pivotal means for pivotally coupling the side edges of the first plate between the side plates to define a pivotable desk top;

extendable means coupled between the desk top and side walls and having one position for allowing desk top to be extended upwards and away from the side plates in an elevated orientation and another position for allowing the desk top to be extended downwards and between the side plates in a retracted orientation;

coupling means adapted for coupling the back plate to a wall and thereby allowing the desk top to be placed in the elevated or retracted orientation; and a container further comprising:

a rectangular bottom plate extended across and coupled to the top edge of the back plate and top edges of the side plates;

a peripheral, planar, and upwardly extended border coupled around the bottom plate of the container to define a rectangular and opened top; and a planar, rectangular, and perforated top plate coupled across the border to cover a portion of the opened top with the perforations adapted for holding elongated items placed therein and projected downwards into the container.

* * * * *